US008544694B2

(12) United States Patent
Waitz

(10) Patent No.: US 8,544,694 B2
(45) Date of Patent: Oct. 1, 2013

(54) CLOSING CAP FOR A DISCHARGE HEAD

(75) Inventor: Karl-Heinz Waitz, Iserlohn (DE)

(73) Assignee: MeadWestvaco Calmar GmbH, Hemer (DE)

( * ) Notice: Subject to any disclaimer, the term of this patent is extended or adjusted under 35 U.S.C. 154(b) by 380 days.

(21) Appl. No.: 12/743,012

(22) PCT Filed: Nov. 21, 2008

(86) PCT No.: PCT/EP2008/009889

§ 371 (c)(1),
(2), (4) Date: Aug. 23, 2010

(87) PCT Pub. No.: WO2009/065599

PCT Pub. Date: May 28, 2009

(65) Prior Publication Data

US 2010/0308081 A1 Dec. 9, 2010

(30) Foreign Application Priority Data

Nov. 22, 2007 (DE) ..... 10 2007 056 380

(51) Int. Cl.
*B67B 1/00* (2006.01)

(52) U.S. Cl.
USPC ..... 222/153.1; 222/153.13; 222/321.7

(58) Field of Classification Search
USPC ..... 222/153.01, 153.02, 153.05, 153.06, 222/153.07, 153.09, 153.1, 153.13, 153.14, 222/153.11; 220/315, 319, 320, 321, 265, 220/266, 268, 269, 270, 298, 300, 301, 302, 220/281; 215/250, 253, 272, 329, 330, 332, 215/335, 336, 337, 339, 340
See application file for complete search history.

(56) References Cited

U.S. PATENT DOCUMENTS

| | | | | |
|---|---|---|---|---|
| 3,977,557 | A * | 8/1976 | Hazard | 215/274 |
| 4,576,296 | A * | 3/1986 | Lecinski | 215/43 |
| 4,805,791 | A * | 2/1989 | Begley | 215/252 |
| 4,805,807 | A * | 2/1989 | Perne et al. | 222/153.06 |
| 4,944,429 | A * | 7/1990 | Bishop et al. | 222/153.13 |
| 5,040,694 | A * | 8/1991 | Gambello | 220/255 |
| 5,147,073 | A | 9/1992 | Cater | |
| 5,441,178 | A * | 8/1995 | Wysocki | 222/182 |

(Continued)

FOREIGN PATENT DOCUMENTS

| | | | |
|---|---|---|---|
| DE | 3315334 | A1 | 10/1984 |
| DE | 19622124 | A1 | 12/1997 |

(Continued)

OTHER PUBLICATIONS

WO2009065599A1 International Search Report, published May 28, 2009.

(Continued)

*Primary Examiner* — Kevin P Shaver
*Assistant Examiner* — Patrick M Buechner
(74) *Attorney, Agent, or Firm* — MWV Intellectual Property Group

(57) ABSTRACT

A closing cap for a discharge head of a medium container, having a bottom part having locking edges and a latch boss, the bottom part fastened to a container neck and detachably latched to a top part having a rim portion which overlaps the bottom part and has locking edges which can be brought into engagement with the locking edges of the top part, as well as a locking arm, having a locking edge, which can be latched behind a latch boss.

15 Claims, 9 Drawing Sheets

(56) References Cited

U.S. PATENT DOCUMENTS

| | | | | |
|---|---|---|---|---|
| 5,443,175 | A * | 8/1995 | Kelly et al. | 220/298 |
| 5,722,546 | A | 3/1998 | Briere | |
| 5,722,568 | A * | 3/1998 | Smith | 222/153.06 |
| 6,112,921 | A * | 9/2000 | Robinson | 215/216 |
| 6,364,166 | B1 * | 4/2002 | Ritsche et al. | 222/153.13 |
| 6,427,684 | B2 * | 8/2002 | Ritsche et al. | 128/200.23 |
| 6,543,649 | B1 * | 4/2003 | Danielo et al. | 222/153.13 |
| 6,886,708 | B2 * | 5/2005 | Kaufman et al. | 220/257.1 |
| 6,926,174 | B1 * | 8/2005 | Heldt | 222/321.7 |
| 6,976,607 | B2 * | 12/2005 | Benoit-Gonin et al. | 222/153.06 |
| 7,971,738 | B2 * | 7/2011 | DeJonge | 215/206 |
| 2001/0002028 | A1 * | 5/2001 | Brecheisen et al. | 222/153.09 |
| 2003/0010793 | A1 * | 1/2003 | Ritsche | 222/153.1 |
| 2005/0205607 | A1 * | 9/2005 | Hierzer et al. | 222/153.1 |
| 2006/0180617 | A1 | 8/2006 | Suffa | |
| 2007/0023452 | A1 * | 2/2007 | Tseng | 222/153.06 |
| 2009/0148490 | A9 * | 6/2009 | Harman et al. | 424/423 |
| 2009/0277930 | A1 * | 11/2009 | Carta | 222/153.01 |
| 2010/0243598 | A1 * | 9/2010 | Straughan | 215/201 |

FOREIGN PATENT DOCUMENTS

| | | | |
|---|---|---|---|
| DE | 29811242 | U1 | 11/1999 |
| DE | 19840723 | A1 | 3/2000 |
| DE | 102004050679 | A1 | 4/2006 |
| EP | 0901836 | A2 | 3/1999 |
| FR | 2624482 | | 6/1988 |
| FR | 264482 | A1 | 6/1989 |
| GB | 2213476 | | 8/1989 |
| GB | 2213476 | A * | 8/1989 |
| WO | 9723388 | | 7/1997 |
| WO | WO9723388 | A1 | 7/1997 |
| WO | 2005030603 | | 4/2005 |
| WO | WO2005030603 | A2 | 4/2005 |
| WO | WO2007009617 | A1 | 1/2007 |

OTHER PUBLICATIONS

WO2009149825A1 International Search Report, published Dec. 17, 2009.

WO2009149826A1 International Search Report, published Dec. 17, 2009.

* cited by examiner 17
11
41
11
12
14
42
13
10
18
19
4
5

41
15
16
4
10
5
40
9
11
8
7
5
4

CLOSING CAP FOR A DISCHARGE HEAD

CROSS-REFERENCE TO RELATED APPLICATIONS

This application is a National Phase entry into the United States and claims the benefit of German Application No. 102007056380.0, entitled "Kindersichere Verschlusskappe für einen Austragkopf," filed Nov. 22, 2007 and PCT Application No. PCT/EP2008/009889, entitled "Kindersichere Verschlusskappe für einen Austragkopf," filed Nov. 21, 2008, and incorporates each of these applications herein by reference in their entireties.

BACKGROUND OF THE INVENTION

1. Field of the Invention

The invention relates to a closing cap for a discharge head of a medium container, having a dosing pump, which can be inserted in a sealed manner into a container neck, for drawing medium out of the medium container and dispensing it in a pump stroke which can be triggered by actuation of the discharge head.

2. State of the Art

Such liquid containers with dosing pumps, especially when their contents constitute a certain risk potential, such as, for example, medicinal products, must be able to be closed in a childproof manner. In the pharmaceutical industry, dosing pumps are used in many different versions, with spray head, drip adapter, throat adapter, etc., to allow a dosed extraction of liquid medications from containers or bottles.

The object of the invention is therefore to provide a childproof closure which prevents children, in particular of a certain age group, from extracting medium from a dosing pump and, at the same time, is simple to manufacture, install and operate.

BRIEF SUMMARY OF THE INVENTION

A closure in the form of a closing cap is hereby provided, which offers a childproof closure and makes extraction by adults only slightly more difficult. At the same time, the closure, as a protective cap, protects the sensitive actuating head from damage. Fitting is possible at all times, including in retrofit. No specific modification or adaptation of the existing dosing pumps is needed. The closing cap is a mount-on part.

Further embodiments of the invention can be derived from the following description and the sub-claims.

BRIEF DESCRIPTION OF THE DRAWINGS

The invention is explained in greater detail below with reference to the illustrative embodiments represented in the appended diagrams, wherein:

FIG. 2 shows a side view of a discharge head.

DETAILED DESCRIPTION OF THE INVENTION

Figure 1:
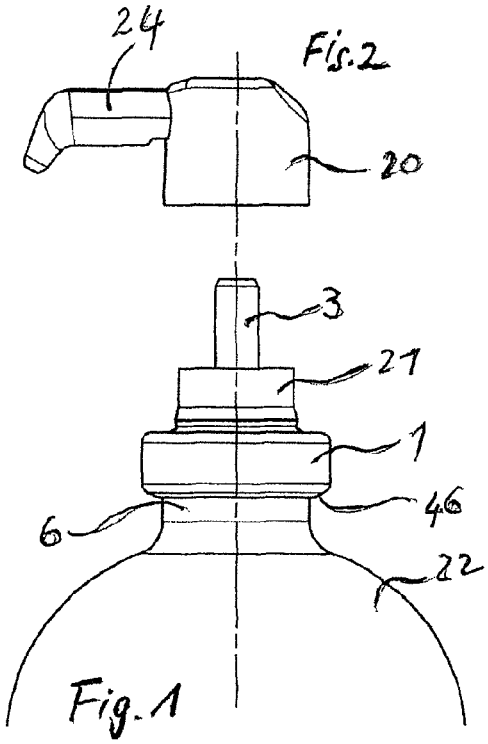
FIG. 1 shows a side view of an upper portion of a medium container with dosing pump.
Figure 3:
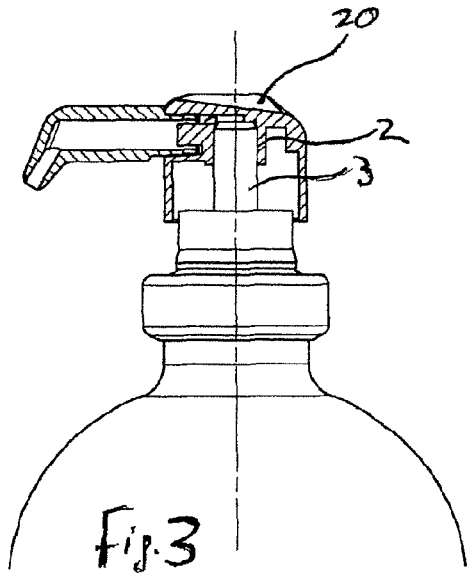
FIG. 3 shows the medium container according to FIG. 1 with mounted discharge head according to FIG. 2.

FIGS. 1 to 3 show a container 22 for medium, or a product, in particular liquid, having a dosing pump 21, on whose cylinder 3 a discharge head 20 can be mounted. The discharge head 20 is at the same time an actuating head and is here configured with a drip adapter 24. The represented dosing pump 21 boasts a flanged ring 1 of metal, which is flanged around a holding edge 46 of the container neck 6. The discharge head 20 is generally mounted onto the cylinder 3 after the flanging of the dosing pump 21.

The dosing pump 21 can alternatively close the container 22 using other types of fastening, such as screw closures or snap closures. The dosing pump 21 can thus be inserted in a sealed manner into the container neck 6, for drawing medium out of the medium container 22 and dispensing it in a pump stroke which can be triggered by actuation of the discharge head 20.

FIG. 3 shows the mounted discharge head 20, which is usually held on the dosing pump 21 purely by a press fit between the cylinder 3 and a receiving bore 2 on the discharge head 20. It is therefore possible at any time to remove the discharge head 20 again with relatively little force.

Figure 4:
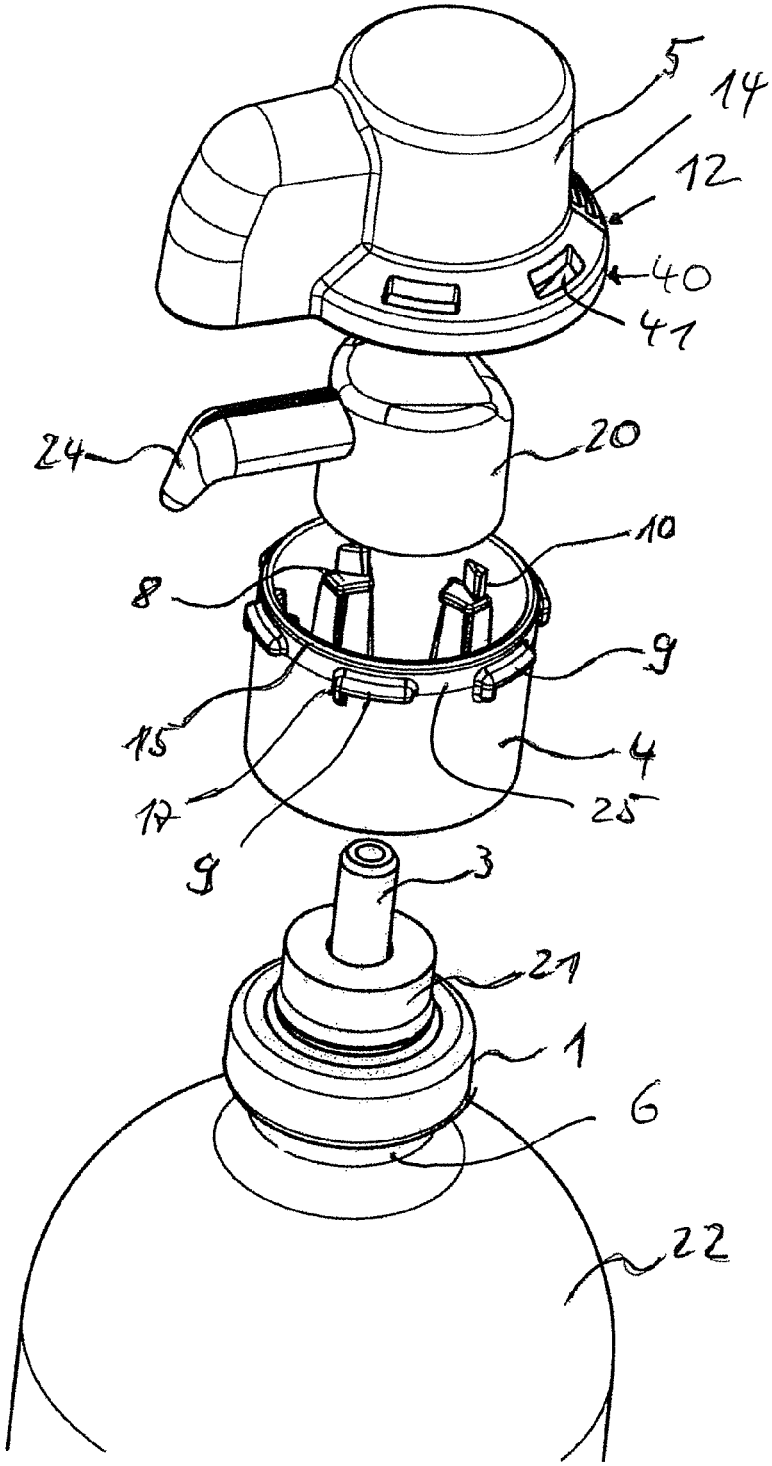
FIG. 4 shows a side view of a closing cap according to a first illustrative embodiment in assembly sequence.

FIG. 4 shows the closing cap according to the invention in the sequence in which it is assembled as a closure. The closing cap accordingly comprises a sleeve-like bottom part 4, which can be fastened to the container neck 6 and can be detachably latched to a top part 5. Preferably, the bottom part 4 is non-detachably connected to the container neck 6, and thus to the container 22 and the inserted and, for example, edge-flanged dosing pump 21. The bottom part 4 is preferably a structural part, in the form of a wide-ring-like sleeve, which can be snap-locked onto the container neck 6, here the flanged ring 1, and which is seated on the flanged ring 1. In addition, the bottom part 4 can also be fastened in a clamp-like manner on the container neck 6.

Figure 6:
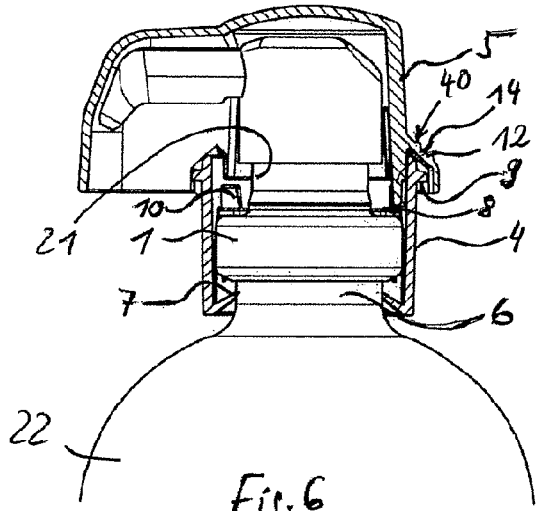
Figures 7, 8:
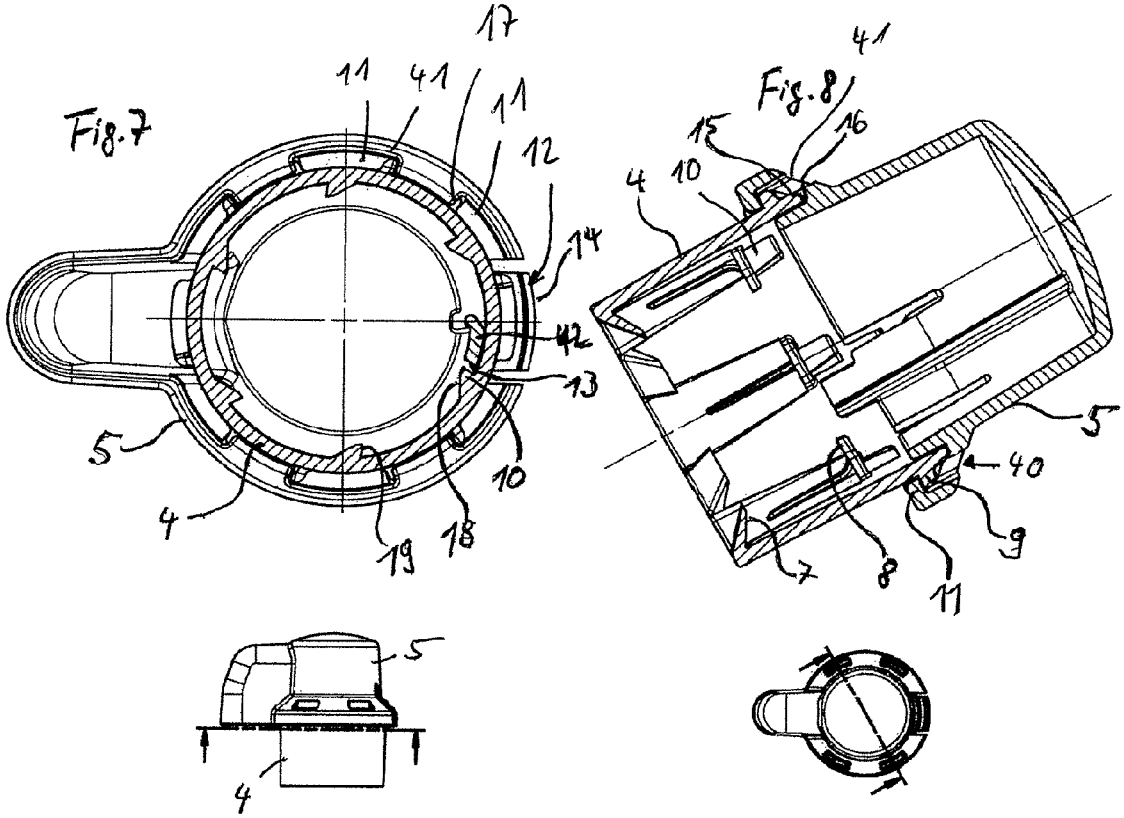
Figure 9:
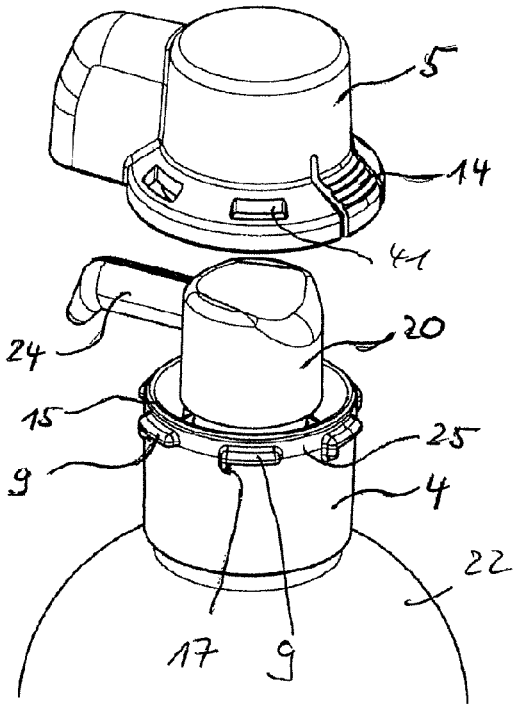
Figure 10:
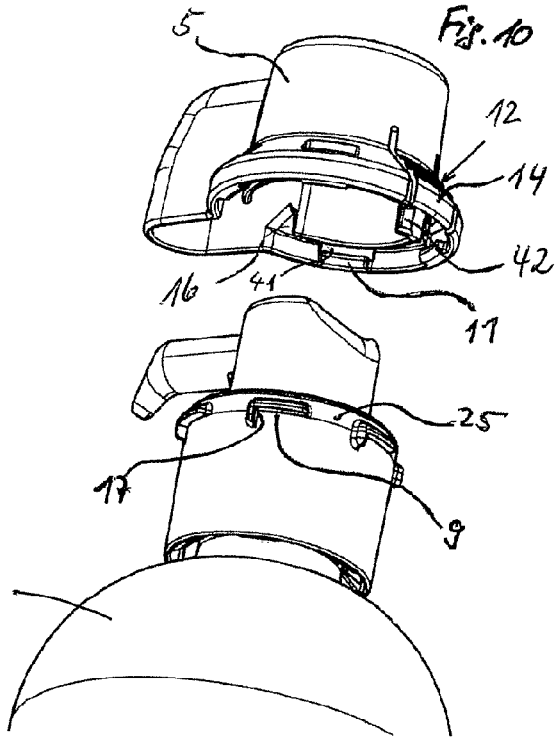

As shown by FIGS. 6 and 8, the bottom part 4 has on a bottom edge, for the fastening to the container neck 6, obliquely angled claws 7, which, when the bottom part 4 is pushed onto the flanged ring 1, can deflect upwards and, once an end position is reached, return to their original position. A removal of the bottom part 4 is then no longer possible. The end position of the bottom part 4 can be determined by means of stops 8. The flanged ring 1 is then clamped in place between the claws 7 and the stops 8.

FIG. 4 shows that the bottom part 4, for locking to the top part 5, has locking edges 9 on the outer side. A number of locking edges 9 are distributed over the periphery and are arranged at a distance apart along an upper rim region of the bottom part 4. The locking edges 9 are ribs which protrude relative to the outer side and which, at one end, each have a stop 17. Between the locking edges 9, gaps 25 are respectively left. The bottom part 4 further has on an inner side latch bosses 10, which protrude relative to the inner side. The latch bosses 10 are arranged on the inner side distributed over the periphery and leave a radial distance to the outer periphery of the dosing pump 21. The position of the locking edges 9 and of the latch bosses 10 can be mutually aligned so as to obtain a latching to locking elements on the top part 5, as is described below. In addition, the bottom part 4 preferably boasts a slide face 15, which can be formed by a top edge of the sleeve-like bottom part 4.

Figure 5:
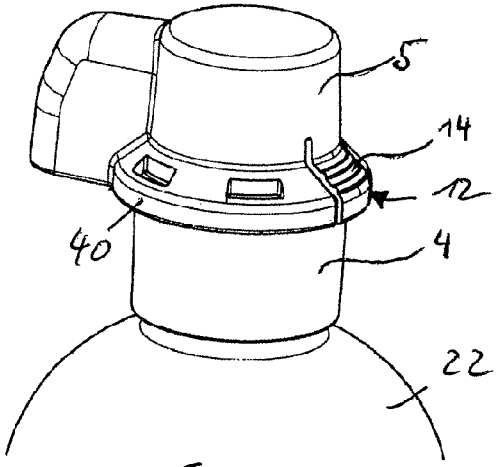
FIG. 5 shows a side view of the fitted closing cap according to FIG. 4, FIGS. 6 to 8 show different sections from FIG. 5, FIGS. 9 and 10 show elevations of the closing cap according to FIG. 4, with fitted bottom part and removed top part.

As shown by FIGS. 4 to 6, the top part 5 is configured in the style of a cap and has a widening lower rim region 40, which overlaps the upper rim region of the bottom part 4, where the locking edges 9 are disposed.

As shown by FIGS. 7 to 10, the top part 5 has on a lower edge of the lower rim region 40 internally protruding locking edges 11, which can be brought into engagement with the locking edges 9 of the bottom part 4, thereby preventing a removal of the top part 5. Preferably, the top part 5 reaches with its locking edges 11 under the locking edges 9 of the bottom part 4. To the slide face 15 on the bottom part 4 there is preferably also assigned an opposing slide face 16 on the top part 5, as can be seen from FIG. 8. For the locking, the top part 5 is mounted such that the locking edges 11 of the top part 5 are pushed downwards through the gaps 25 of the locking edges 9 of the bottom part 4 until the slide face 15 of the bottom part 4 and the opposing slide face 16 of the top part 5 lie one upon the other. The top part 5 is then turned clockwise, so that the locking edges 11 of the top part 5 slide under the locking edges 9 of the bottom part 4 as far as the stop 17. The top part 5 preferably has, parallel to the locking edges 11, above-situated recesses 41, through which the locking edges 9 of the bottom part 4 are visible during the latching process. The locking edges 11 of the top part 5 are preferably ribs, with a length matched to the length of the gaps 25, so that it is easily possible to slide through the same.

In addition, the top part 5 boasts a formed-on resilient locking arm 12, having an actuating surface 14. The locking arm 12 has a latching tooth 42, having a locking edge 13 which, in interaction with the latch bosses 10 of the bottom part 4, prevents a rotary motion which is necessary for the unlocking. The latching tooth 42 is situated on a peripheral line inwardly distanced from the peripheral line on which the locking edges 11 are disposed. The latching tooth 42, by entering into engagement with the latch bosses 10 on the inner side of the bottom part 4, can latch-lock the top part 5. To this effect, the latching tooth 42 is moved behind a latch boss 10. As a result of the resilient coupling, the latching tooth 42 can be moved over the latch boss 10 and cannot be turned back without renewed inward deflection of the latching tooth 42 by the application of pressure to the actuating surface 14. In the other rotational direction, preferably in the clockwise direction, a block is applied by the stop 17 on the locking edges 9, against which latter the locking edges 11 on the top part 5 butt.

By means of the actuating surface 14, it is consequently possible from outside to bring the locking edge 13 into a setting that releases the latch bosses 10, by pressing on the actuating surface 14 and, at the same time, turning the top part 5, so that the locking edges 11 on the top part 5 are turned into the position of the gaps 25 on the bottom part 4.

For the latching, the resilient locking arm 12 of the top part 5 is pressed inwards, counter to the spring force 4, preferably against bevels 18 on the latch bosses 10 of the bottom part 4. Once the end setting is reached, as represented in FIG. 7, the locking edge 13 of the locking arm 12 springs behind a holding edge 19 of the latch boss 10. The top part is now in the locked state. The actuation or removal of the discharge head 20 is no longer possible. In order to unlock the top part again, the locking edge must be brought into the release setting with the aid of the actuating surface of the locking arm 12, whilst, at the same time, the top part 5 must be turned anti-clockwise.

The bottom part 4, which is non-detachably connected to the container 22 and the flanged ring 1, can still be freely rotated about its axis. An additional degree of difficulty is thereby obtained, because, as the top part 5 is unlocked, the bottom part 4 must be secured with the other hand.

Figure 11:
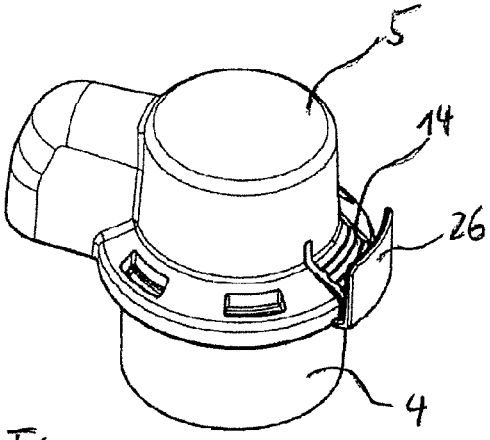
FIG. 11 shows a side view of a fitted closing cap according to a second illustrative embodiment.
Figure 12:
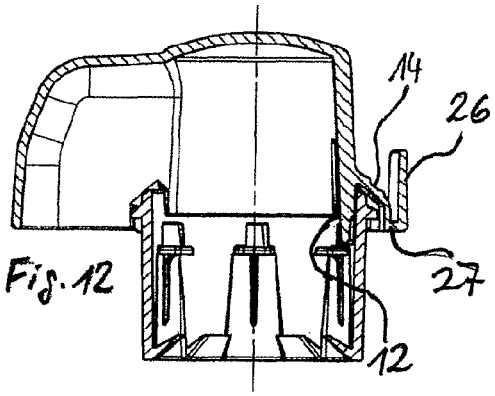
FIG. 12 shows a section according to FIG. 11.
Figure 13:
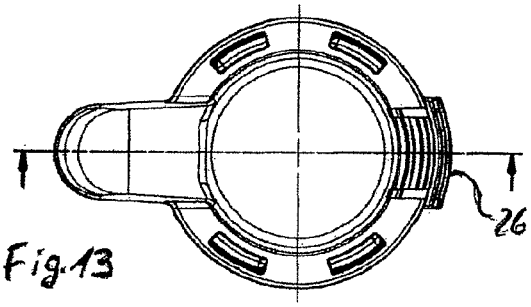
FIG. 13 shows a top view of the fitted closing cap according to FIG. 11.

FIGS. 11 to 13 show a second illustrative embodiment of the closing cap with a formed-on lug 26, which serves as a quality assurance. The lug 26 is connected to the top part 5 by a predetermined breaking point 27. The lug 26 is here arranged such that the unlocking motion of the locking arm 12 is prevented if an attempt is made, via the actuating surface 14, to unlock the top part 5. Only once the lug 26 has been broken off or removed, can the top part 5 be unlocked.

Figure 14:
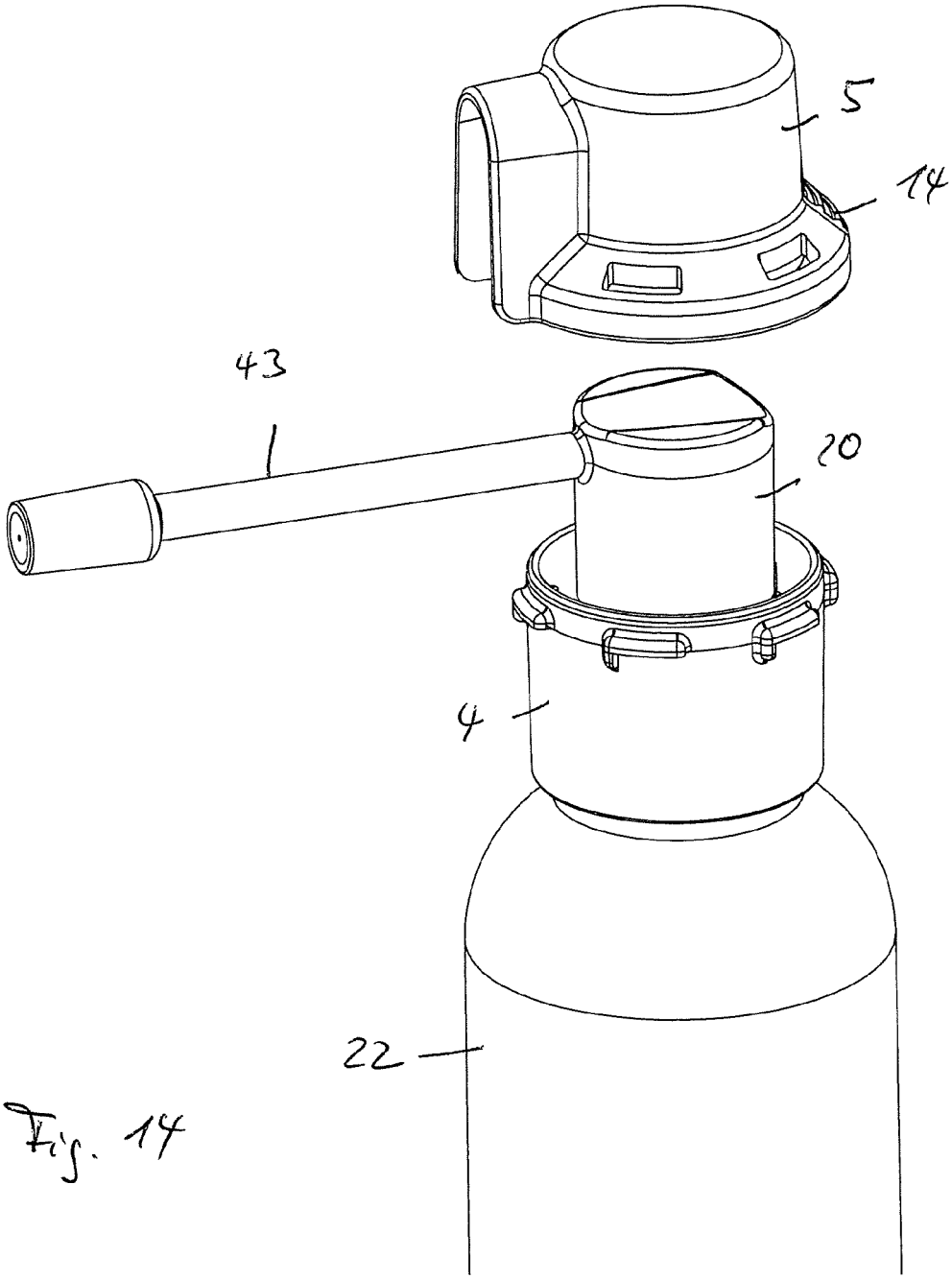
FIG. 14 shows an elevation of the closing cap according to a third illustrative embodiment, with fitted bottom part and removed top part.
Figure 15:
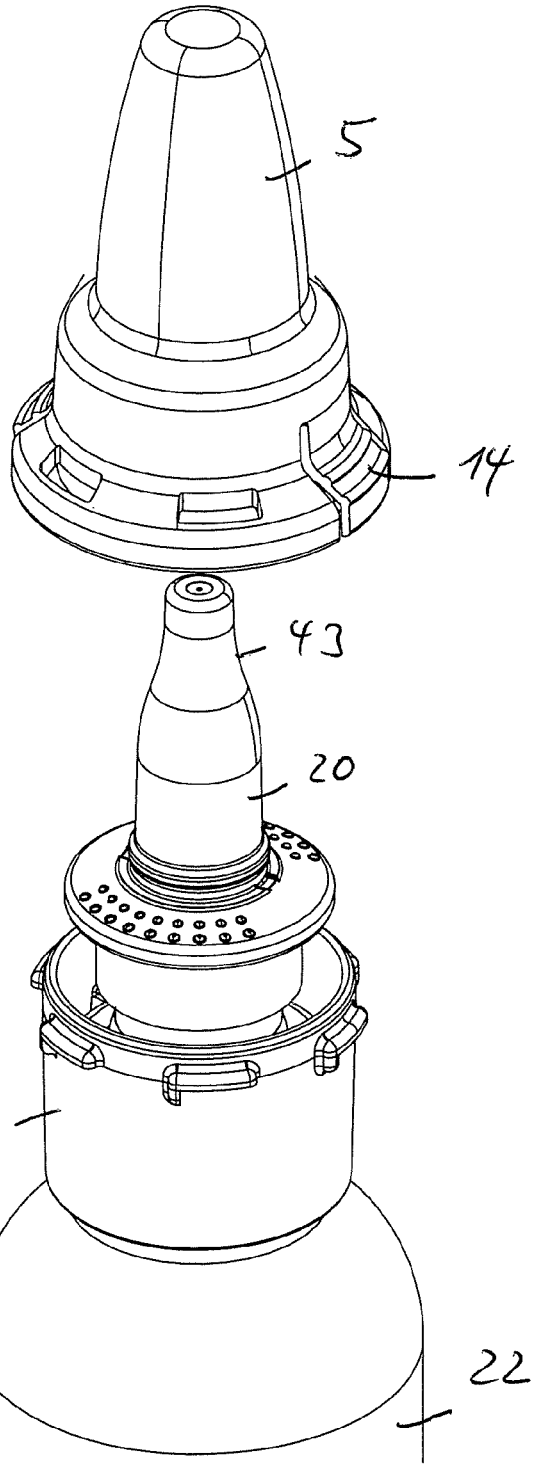
FIG. 15 shows an elevation of the closing cap according to a fourth illustrative embodiment, with fitted bottom part and removed top part.
Figure 16:
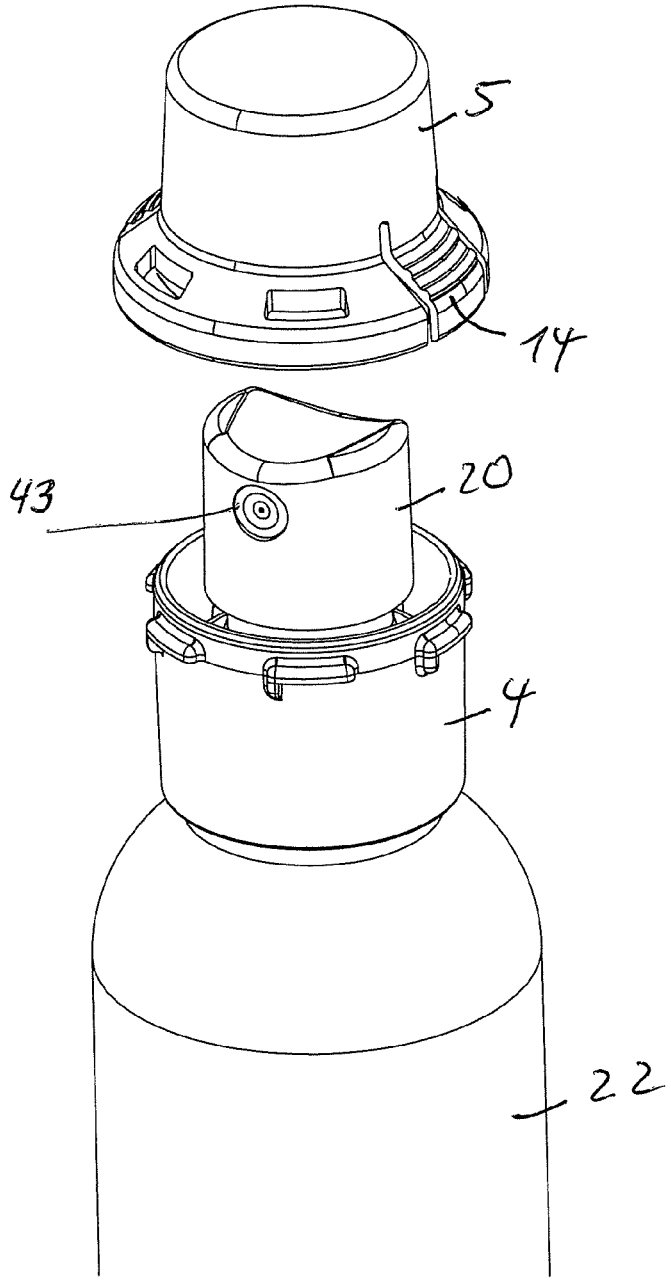
FIG. 16 shows an elevation of the closing cap according to a fifth illustrative embodiment, with fitted bottom part and removed top part.

FIGS. 14 to 16 show further illustrative embodiments, which differ from the first, above-described illustrative embodiment in that the discharge head 20 is differently shaped for different applications. The respective discharge head 20 here has a dispensing device 43, which is variously shaped. The top part 5, which is usable as a protective cap, is in each case matched appropriately thereto. Otherwise, the above comments apply correspondingly.

What is claimed is:

1. A closing cap, comprising:
- a bottom part, comprising:
  - at least one bottom part locking edge on an outer side thereof; and
  - at least one latch boss on an inner side thereof;
- a top part, comprising:
  - a rim portion configured to overlap at least a portion of the bottom part;
  - at least one top part locking edge on an inner surface of the top part;
  - a recess situated parallel to each top part locking edge;
  - a locking arm, comprising:
    - an actuating surface; and
    - a latching tooth having a locking edge;
- wherein in a locked position, the at least one bottom part locking edge is mated with the at least one top part locking edge and is visible through the recess and the locking edge of the latching tooth is latched by the at least one latch boss.

2. The closing cap of claim 1, wherein the at least one bottom part locking edge comprises a plurality of bottom part locking edges distributed over a periphery of the outer side of the bottom part.

3. The closing cap of claim 1, wherein the at least one bottom part locking edge comprises at least one rib protruding relative to the outer side of the bottom part.

4. The closing cap of claim 1, wherein the bottom part further comprises at least two obliquely angled claws.

5. The closing cap of claim 1, wherein the at least one top part locking edge comprises a plurality of top part locking edges distributed over a periphery of the inner surface of the top part.

6. The closing cap of claim 1, wherein the top part is a protective cap.

7. The closing cap of claim 1, wherein the at least one top part locking edge further comprises a stop.

8. The closing cap of claim 1, further comprising:
- a container having a container neck;
- a dosing pump inserted in the container and sealed about the container neck; and wherein the bottom part of the closing cap is fastened to the container neck.

9. A closing cap for a container having a dosing pump, comprising:

a bottom part fastened to a container, the bottom part comprising:

at least one bottom part locking edge on an outer side thereof; and at least one latch boss on an inner side thereof;

a top part detachably latched to the bottom part, comprising:

a rim portion configured to overlap at least an outer portion of the bottom part;

at least one top part locking edge on an inner surface of the top part; and a locking arm, comprising:

an actuating surface in the rim portion of the top part; and a locking edge in communication with the actuating surface and configured to engage the at least one latch boss;

wherein in a locked position the at least one bottom part locking edge is mated with the at least one top part locking edge and a portion of the bottom part is positioned between the actuating surface and the locking edge, the locking edge latched by the at least one latch boss.

10. The closing cap of claim 9, wherein the bottom part is freely rotatable about its longitudinal axis.

11. The closing cap of claim 9, wherein the at least one bottom part locking edge comprises a plurality of bottom part locking edges distributed over a periphery of the outer side of the bottom part.

12. The closing cap of claim 9, wherein the at least one top part locking edge comprises a plurality of top part locking edges distributed over a periphery of the inner surface of the top part.

13. The closing cap of claim 9, wherein the top part is a protective cap.

14. The closing cap of claim 9, wherein the at least one top part locking edge further comprises a stop.

15. The closing cap of claim 9, wherein the bottom part is nom-detachably fastened to the container.

* * * * *